US007578730B2

(12) United States Patent
Chen

(10) Patent No.: US 7,578,730 B2
(45) Date of Patent: Aug. 25, 2009

(54) GRINDING BRUSH FIXING DEVICE

(75) Inventor: Lung-Pao Chen, Hsinchu County (TW)

(73) Assignee: Sunmatch Industrial Co., Ltd., Hsinchu County (TW)

( * ) Notice: Subject to any disclaimer, the term of this patent is extended or adjusted under 35 U.S.C. 154(b) by 63 days.

(21) Appl. No.: 11/907,272

(22) Filed: Oct. 10, 2007

(65) Prior Publication Data

US 2009/0098813 A1 Apr. 16, 2009

(51) Int. Cl.
*B24B 9/02* (2006.01)

(52) U.S. Cl. ..... 451/466; 451/477; 451/508; 451/515; 451/358; 403/341; 403/348

(58) Field of Classification Search ..... 451/466, 451/477, 508, 509, 514, 515, 516, 520, 344, 451/350, 358, 359, 365; 403/341, 348, 194, 403/195

See application file for complete search history.

(56) References Cited

U.S. PATENT DOCUMENTS 3,574,978 A * 4/1971 Block ..... 451/509
4,365,448 A * 12/1982 Wilson ..... 451/466
5,094,563 A * 3/1992 Carletti ..... 403/194
5,386,608 A * 2/1995 Montabaur et al. ..... 15/179
5,390,448 A * 2/1995 Schimweg ..... 451/478
6,302,617 B1 * 10/2001 Rumpp ..... 403/348
6,912,755 B2 * 7/2005 Chen ..... 15/179
7,007,900 B2 * 3/2006 Goodwin et al. ..... 248/68.1
7,147,550 B2 * 12/2006 Chen ..... 451/520
2004/0028486 A1 * 2/2004 Englund ..... 407/90
2005/0223400 A1 * 10/2005 Matsushita et al. ..... 720/702
2006/0037871 A1 * 2/2006 Jin et al. ..... 206/5.1

FOREIGN PATENT DOCUMENTS

DE 4205265 C1 8/1993

* cited by examiner

*Primary Examiner*—Eileen P. Morgan
(74) *Attorney, Agent, or Firm*—Muncy, Geissler, Olds & Lowe, PLLC

(57) ABSTRACT

The present invention discloses a grinding brush fixing device applying to a pneumatic tool for surface treatment. The spacing between the fixing arms and arc plates of the brush holder is reduced. Thereby, the press-fit face of the axially-extending fixing arm can press the brush collar onto the first press-fit edge and second press-fit edge, which are at two sides of the notches between two axially-extending arc plates. Further, a flexible gasket is radially placed in a space between the fixing arms and the arc plates. When the fixing disc is fastened to the brush holder, the flexible gasket and the brush collar are tightly compressed and firmly secured. Thus, force can be uniformly applied onto the brush collar and the bristles. The present invention can promote the stability of brush's rotation, generate straighter ground strips, prolong the durability of the grinding brush and grinding brush fixing device, and promote the grinding efficiency.

4 Claims, 5 Drawing Sheets

GRINDING BRUSH FIXING DEVICE

FIELD OF THE INVENTION

The present invention relates to a part of a surface-treatment tool, particularly to a grinding brush fixing device for a pneumatic tool for surface treatment.

BACKGROUND OF THE INVENTION

In pneumatic grinding tools, compressed air provides power to the pneumatic tool to drive the pneumatic motor to rotate the pneumatic tool's shaft which couples to the grinding material. Thus, the grinding material at the end of the shaft can rotate and do the grinding job. Generally, the grinding materials on the market can be divided into at least the grinding brushes and the grinding wheels. The grinding brush has a flexible collar and metal bristles radially project outwards from the collar. Usually, the collar has a thickness of about 2.0 mm. Besides, according to the assembly way, there are two methods to install the grinding material on the pneumatic tool. One is that the grinding material itself has a fixing element at the center thereof to engage with the shaft. In other words, the grinding material and the fixing element are fabricated into a one-piece part. The other is that the grinding material has no built-in fixing element but needs a fixing element in order to install it to the shaft. In other words, the fixing element is separated from the grinding material and can be repeatedly used. This shows that if to have the separation type grinding materials installed firmly on the shaft, a fixing device for holding the grinding materials is needed. The present invention relatives to a separation type grinding brush, which also needs a separated fixing device. Therefore, only the prior arts of the separation type grinding materials will be discussed below.

A U.S. Pat. No. 5,386,608 (and a corresponding Germany patent DE4205265C1 of the same inventors) disclosed a "Rotary Brush Assembly", which comprises: a brush and a brush holder. The brush is used in surface treatment. The brush holder has a cylinder, and a plurality of flanges radially extends outwards from the cylinder, and a retaining tongue extends axially from each flange. The brush has a flexible collar, and bristles radially project outwards from the collar. The collar also has bristle-free zones. The radially-extending flanges, the axially-extending retaining tongues and the cylinder jointly form a cage-like structure having a radial gap and an axial gap. The outer diameter of the cylinder is smaller than the inner diameter of the collar. The radial gap between the cylinder and the axially-extending retaining tongue is a multiple of the thickness of the collar. The length of the cylinder is greater than the width of the collar. The bristle-free zones are in fact loosely accommodated in the gaps. When the brush rotates, the part of brush collar whereon the bristles projected at between the retaining tongues will bulge in an appearance like three leaves of shamrock.

From the above description, it is known that the retaining tongues apply force to the bristles to drive the annular brush to rotate. In such a case, the brush collar and bristles would receive the force unequally. Thus, the bristles are apt to be distorted and damaged, and the durability of the brush is shortened. The abovementioned shamrock-like bulged bristles are due to the flexibility of the collar. Besides, the bristle-free zones are in fact loosely accommodated in the cage-like structured brush holder. Therefore, during usage, the entire annular brush moves and vibrates up and down, left and right, back and forth. Then, the surface of the cylinder will be persistently impacted and abraded by the bottom of the bristles (the bristles' metal bottom which fixed on the brush band), which will damage the holder and shorten the durability. As the bristles also vibrate and move up and down, left and right, back and forth, it is hard for the user to grind straight ground strips precisely. Furthermore, because the durability of the brush assembly is shortened by the up and down, left and right, back and forth displacements, and because the grinding quality and efficiency is degraded by the same reason, the prior art proposed by the Germany patent DE4205265C1 still has much room to improve.

SUMMARY OF THE INVENTION

The primary objective of the present invention is to provide a grinding brush fixing device, which can reliably hold a brush's collar and drive the brush to rotate uniformly, thus which can promote the stability of brush's rotation, generate straighter ground strips, prolong the durability of the grinding brush and grinding brush fixing device, and promote the grinding efficiency.

To achieve the abovementioned objective, the present invention proposes a grinding brush fixing device, which is used to support and hold an annular grinding brush, the grinding brush comprises a flexible brush collar, and the metal bristles which project radially outwards from the collar, the bristles are formed to a plurality of clusters for grinding usage of surface treatment. The grinding brush fixing device of the present invention comprises: a brush holder, a flexible gasket and a fixing disc.

The brush holder has a cylindrical axis portion. At least three arc plates are equispaced and axially extend from a circle which is drawn outside equidistantly from the axis portion. Both sides of each axially-extending arc plate are respectively a first press-fit edge and a second press-fit edge. A notch is formed in between each two neighboring axially-extending arc plates. A fixing arm extends axially and equidistantly from each notch. The inner side of the fixing arm has a press-fit face, which cooperates with the first press-fit edge and the second press-fit edge to form a press-fit mechanism for the brush collar.

The flexible gasket is an annular structure and radially placed in a space between the fixing arms and the arc plates and is compressed by the brush holder and the brush collar.

The fixing disc is tightly pressed against the ends of the fixing arms and arc plates to compress the brush collar.

The technical contents and preferred embodiments of the present invention will be described in cooperation with the drawings below.

DETAILED DESCRIPTION OF THE PREFERRED EMBODIMENTS

Figure 1:
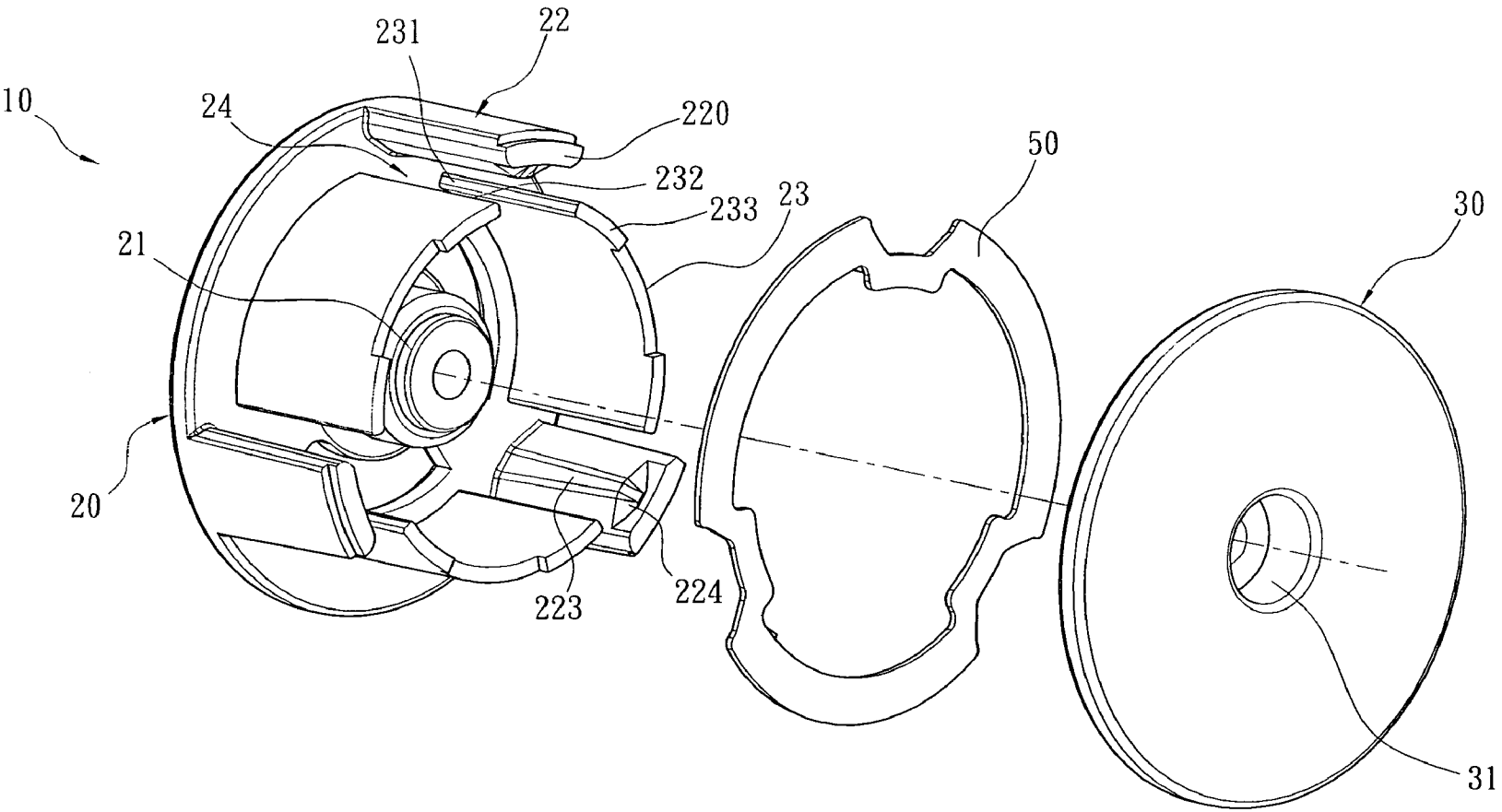
FIG. 1 is an exploded view schematically showing the grinding brush fixing device according to the present invention.
Figure 2:
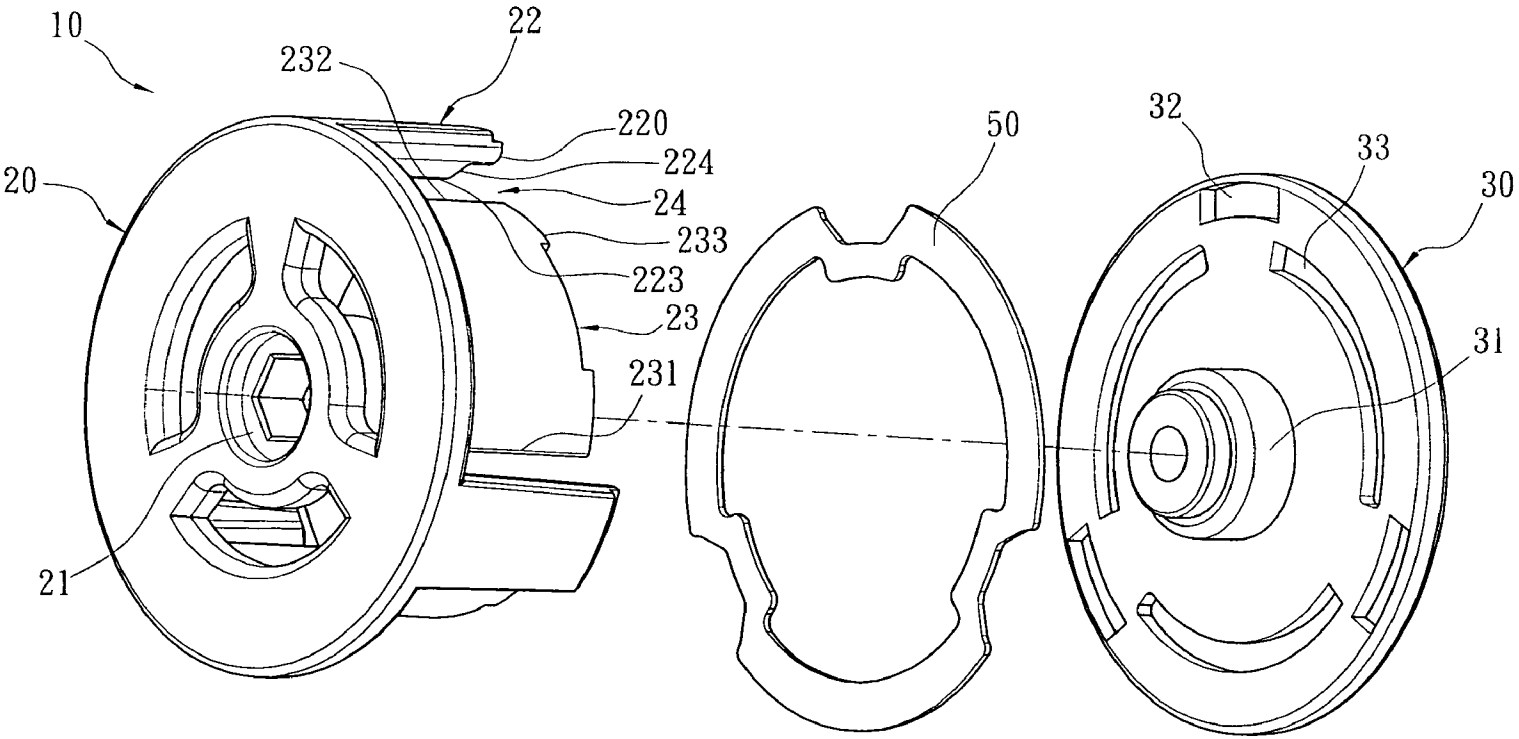
FIG. 2 is an exploded view from a different angle of view schematically showing the grinding brush fixing device according to the present invention.
Figure 3:
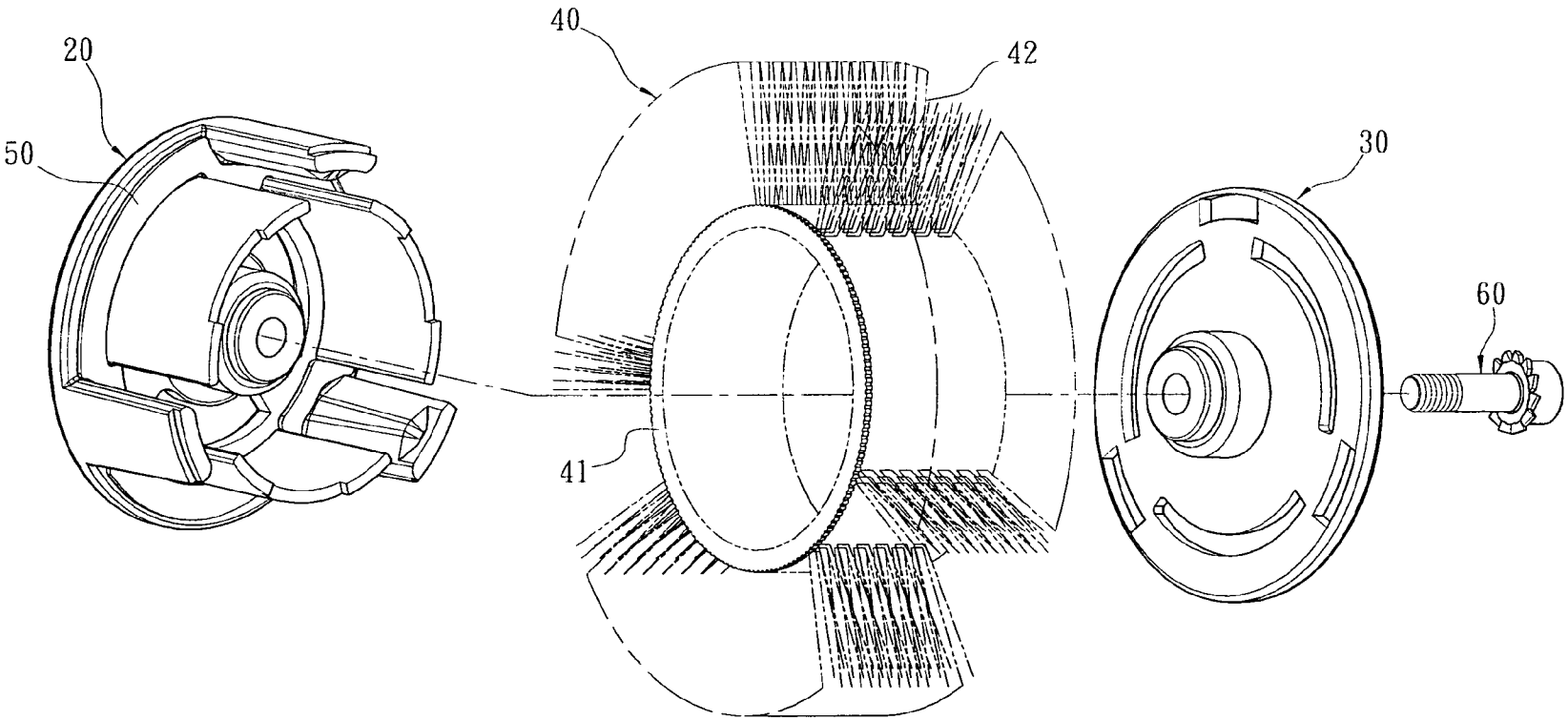
FIG. 3 is an exploded view schematically that the grinding brush fixing device holds a grinding brush according to the present invention.

Refer to from FIG. 1 to FIG. 3 exploded views from different viewing angles of the grinding brush fixing device, and an exploded view schematically that the grinding brush fixing device holds a grinding brush, according to the present invention. The grinding brush fixing device 10 of the present invention is used to support and hold an annular grinding brush 40. The grinding brush 40 has a flexible brush collar 41. The brush bristles 42 made of metal project radially outwards from the brush collar 41, and being formed to a plurality of clusters for grinding usage of surface treatment. The grinding brush fixing device 10 comprises a brush holder 20, a flexible gasket 50 and a fixing disc 30. The brush holder 20 has a cylindrical axis portion 21. Three axial arc plates 23 are equispaced and axially extend from a circle which is drawn outside equidistantly from the cylindrical axis portion 21. Both sides of each axially-extending arc plate 23 are respectively a first press-fit edge 231 and a second press-fit edge 232. A notch 24 is formed in between each two neighboring axially-extending arc plates 23. A fixing arm 22 extends axially and equidistantly from each notch 24. The inner side of the fixing arm 22 has a press-fit face 223, which cooperates with the first press-fit edge 231 and second press-fit edge 232 to form a press-fit mechanism (referring to FIG. 6 also). The gasket 50 is an annular structure and radially placed in the space between the fixing arms 22 and the arc plates 23 and is compressed by the brush holder 20 and the brush collar 41 (referring to FIG. 4B also). The fixing disc 30 is tightly pressed against the ends of the fixing arms 22 and the arc plates 23 to compress the brush collar 41. The fixing disc 30 has an axis portion 31 corresponding to the cylindrical axis portion 21, and has slots 33 corresponding to the arc plates 23, and has slots 32 corresponding to the fixing arms 22. The arc plate 23 has a protrusion block 233 to be inserted into the slot 33. The fixing arm 22 has a protrusion block 220 to be inserted into the slot 32. The fixing arm 22 also has an incline 224 along the inner radial side of the protrusion block 220 to convenience the installation of the grinding brush 40. A fixing element 60, such as a screw, is inserted through the axis portion 31 of the fixing disc 30 and the cylindrical axis portion 21 of the brush holder 20 to fasten the fixing arms 22 and the arc plates 23 to the fixing disc 30.

Figure 4B:
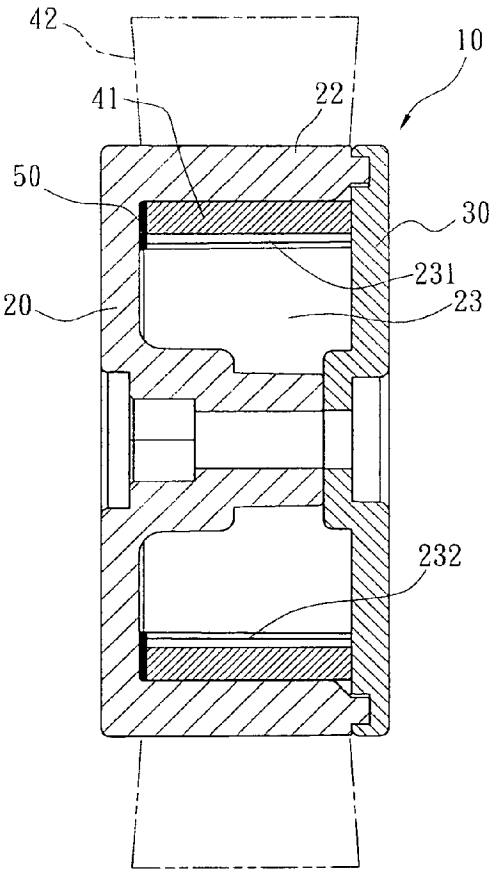
FIG. 4B is a sectional view of FIG. 4A.
Figure 4A:
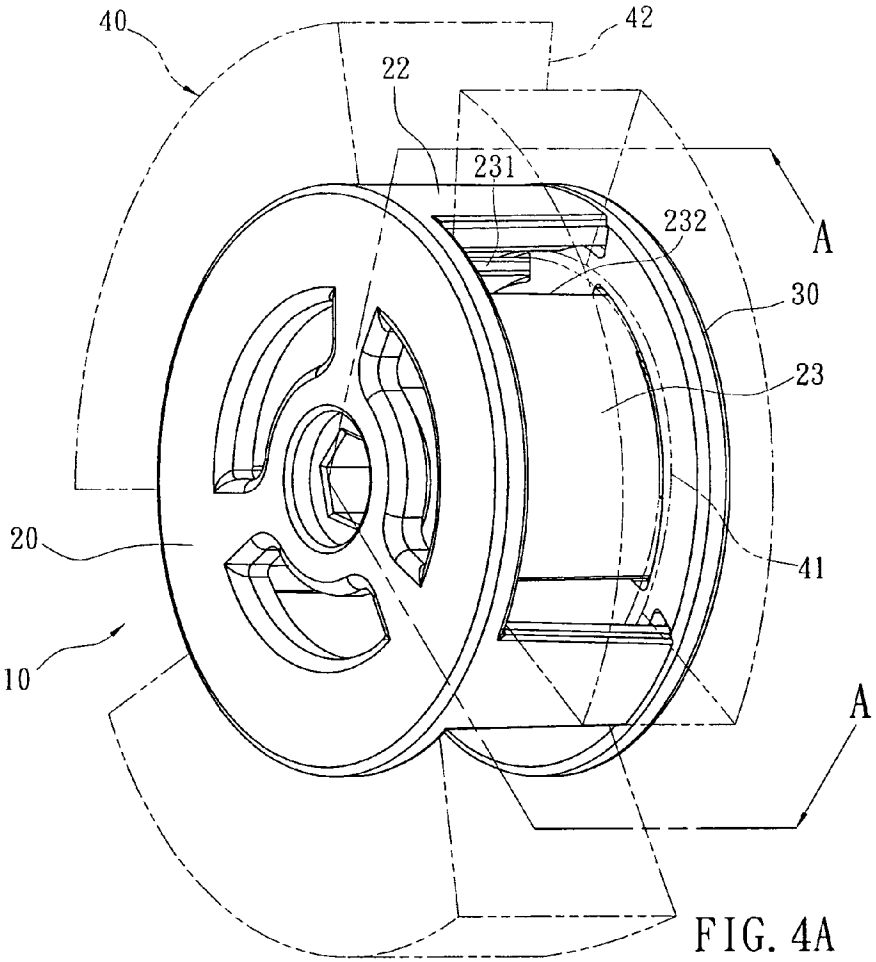
FIG. 4A is a perspective view schematically showing the assembly of the grinding brush fixing device and the grinding brush according to the present invention.

Refer to FIG. 4A and FIG. 4B, a perspective view and a sectional view schematically showing the assembly of the grinding brush fixing device and the grinding brush according to the present invention. As shown in the drawings, the width of the brush collar 41 approximates the axial spacing between the brush holder 20 and the fixing disc 30. Further, the gasket 50 is placed in the inner side of the brush holder 20 and in the radial gap between the fixing arms 22 and the arc plates 23, and compressed by the brush holder 20 and the brush collar 41. Furthermore, the fixing disc 30 is engaged with and fastened to the ends of the fixing arms 22 and the arc plates 23 to tightly compress the brush collar 41. Thus, after assembly, the brush collar 41 is firmly secured inside the space without any swing.

Figure 6:
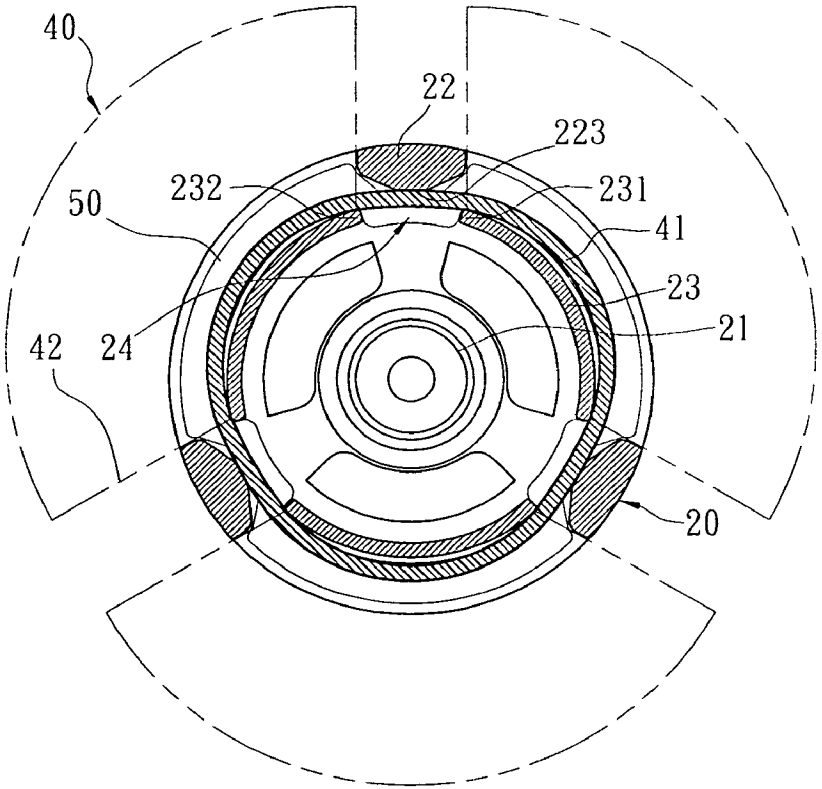
FIG. 6 is sectional view schematically showing the assembly of the grinding brush and the grinding brush fixing device according to the present invention.
Figure 5:
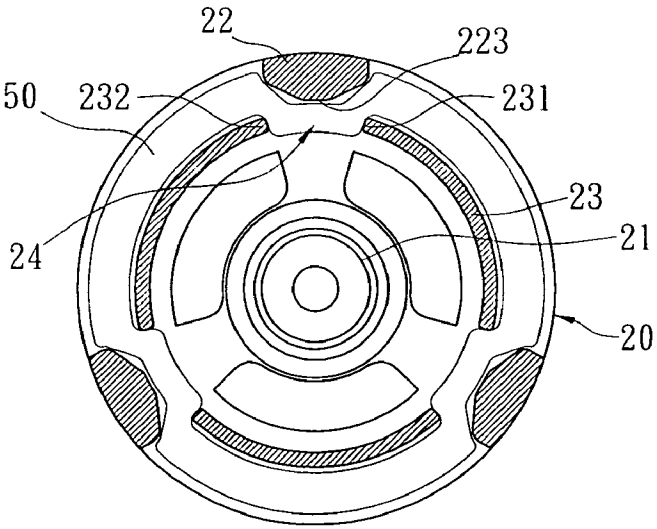
FIG. 5 is a sectional view schematically showing the grinding brush fixing device according to the present invention.

Refer to FIG. 5 and FIG. 6 sectional views schematically showing the grinding brush fixing device and the assembly of the grinding brush and the grinding brush fixing device according to the present invention. As shown in the drawings, the spacing between the fixing arms 22 and the arc plates 23 is reduced; therefore, the press-fit face 223 can cooperate with the first press-fit edge 231 and second press-fit edge 232 beside the notch 24 to form a press-fit mechanism to press-fit the brush collar 41. In the present invention, there are at least three notches 24 to form the press-fit mechanisms. Therefore, the grinding brush fixing device 10 can reliably drive the brush collar 41 to rotate.

From the above description, the present invention has the advantages over the prior arts:

1. As the spacing between the fixing arms 22 and the arc plates 23 is reduced, the press-fit face 223 can cooperate with the first press-fit edge 231 and second press-fit edge 232 beside the notch 24 to form a press-fit mechanism to press-fit the brush collar 41. In the present invention, there are at least three notches 24 to form the press-fit mechanisms. Thus, the grinding brush fixing device 10 can reliably drive the brush collar 41 to rotate. Further, the width of the brush collar 41 approximates the axial spacing between the brush holder 20 and the fixing disc 30, and the flexible gasket 50 is placed in the inner side of the brush holder 20 and in the radial gap between the fixing arms 22 and the arc plates 23, and compressed by the brush holder 20 and the brush collar 41. Thus, after assembly, the brush collar 41 is firmly secured inside the space without any swing. Thereby, force can be uniformly applied onto the brush collar 41 and the bristles 42, and the bristles 42 are less likely to be distorted or damaged.

2. As the spacing between the fixing arms 22 and the arc plates 23 is reduced, the press-fit face 223 can cooperate with the first press-fit edge 231 and second press-fit edge 232 beside the notch 24 to form a press-fit mechanism to press-fit the brush collar 41. Thus, there are at least three press-fit mechanisms radially existing on the brush collar 41. Further, the width of the brush collar 41 approximates the axial spacing between the brush holder 20 and the fixing disc 30, and the flexible gasket 50 is placed in the inner side of the brush holder 20. Thus, after assembly, the brush collar 41 is firmly secured inside the space and unlikely to move up and down, left and right, back and forth. Then, the arc plates 23 are less likely to be damaged by the impact or abrasion from the bottom of the bristles 42.

3. As the brush collar 41 is unlikely to move up and down, left and right, back and forth, the bristles 42 are unlikely to swing. Therefore, a user can generate straighter strips if necessary.

4. As the brush collar 41 is firmly secured to the grinding brush fixing device 10, the durability of the grinding brush 40 and grinding brush fixing device 10, and the grinding efficiency are greatly increased.

The preferred embodiments described above are only to exemplify the present invention but not to limit the scope of the present invention. Any equivalent modification or variation according to the spirit of the present invention is to be also included within the scope of the present invention.

What is claimed is:

1. A grinding brush fixing device, which is used to support and hold an annular grinding brush, wherein the grinding brush has a flexible brush collar, and bristles projecting radially outward from the collar and forming a plurality of clusters for a grinding surface treatment, the grinding brush fixing device comprising:

a brush holder, wherein the brush holder has a first cylindrical axis portion; at least 3 arc plates equispaced and axially extending equidistantly from the first axis portion along a first circle; two circumferential ends of each of the axially-extending arc plates forming a first press-fit edge and a second press-fit edge for holding the grinding brush; a notch is formed between neighboring axially-extending arc plates; at least 3 fixing arms extending axially and equidistantly from the first axis portion along a second circle having a larger diameter than said first circle and opposite each notch; and an inner side of each fixing arm has a press-fit face, which cooperates with a first press-fit edge and a second press-fit edge of neighboring arc plates of the corresponding notch to form a press-fit mechanism for the brush collar;

a flexible gasket, which is an annular structure and radially placed in a space between the fixing arms and the arc plates and is compressed by the brush holder and the brush collar; and a fixing disk tightly pressed against ends of the fixing arms and the arc plates to compress the brush collar therebetween, with the brush collar being radially between the arc plates and the fixing disk;

wherein the fixing disk has a second axis portion corresponding to the first axis portion, and has first slots corresponding to the arc plates, and has second slots corresponding to the fixing arms;

wherein each arc plate has a protrusion block extending axially from an edge opposite the first axis portion, to be inserted into the first slot; each fixing arm has a protrusion block extending axially from an edge opposite to the first axis portion to be inserted into the second slot; and wherein each fixing arm has a surface inclined downwardly and radially inward toward a center axis of the first portion along an inner radial side of the protrusion block.

2. The grinding brush fixing device according to claim 1, further comprising a fixing element which is inserted through the first axis portion and the second axis portion to join the axis portions.

3. The grinding brush fixing device according to claim 2, wherein the fixing element is a screw.

4. The grinding brush fixing device according to claim 1, wherein the bristles are made of metal.

* * * * *